United States Patent [19]

Chase, III

[11] Patent Number: 4,843,781

[45] Date of Patent: Jul. 4, 1989

[54] COMPOSITE ACCESS FLOOR PANEL

[76] Inventor: Francis H. Chase, III, 123 Winnisimet Dr., Tiverton, R.I. 02878

[21] Appl. No.: 122,520

[22] Filed: Nov. 20, 1987

Related U.S. Application Data

[63] Continuation of Ser. No. 887,740, Jul. 18, 1986, abandoned.

[51] Int. Cl.[4] ..... E04C 2/34

[52] U.S. Cl. ..... 52/805; 52/802; 52/808

[58] Field of Search ..... 52/805, 803, 802, 804, 52/806, 808, 813, 126.6, 126.5, 306, 307, 308, 811

[56] References Cited

U.S. PATENT DOCUMENTS

| | | | |
|---|---|---|---|
| 185,732 | 8/1876 | Dickinson . | |
| 237,416 | 2/1881 | Tiffany . | |
| 2,867,301 | 1/1959 | Benton | 189/34 |
| 3,025,934 | 3/1962 | Spiselman et al. | 52/126.6 |
| 3,067,843 | 12/1962 | Rushtoh et al. | 189/34 |
| 3,110,370 | 11/1963 | Wulf, Jr. et al. | 52/802 |
| 3,157,254 | 11/1964 | Spiselman et al. | 189/34 |
| 3,252,260 | 5/1966 | Mills | 52/803 |
| 3,279,134 | 10/1966 | Donovan | 52/126 |
| 3,295,272 | 1/1967 | Kanno | 52/126 |
| 3,396,501 | 8/1968 | Tate | 52/173 |
| 3,420,012 | 1/1969 | Lesley, Jr. et al. | 52/813 |
| 3,548,559 | 12/1970 | Levine et al. | 52/619 |
| 3,568,390 | 3/1971 | Swensen et al. | 52/619 |
| 3,696,578 | 10/1972 | Swensen et al. | 52/813 |
| 3,811,237 | 5/1974 | Bettinger | 52/126 |
| 3,992,839 | 11/1976 | La Borde | 52/802 |
| 4,067,156 | 1/1978 | Downing | 52/126 |
| 4,203,268 | 5/1980 | Gladden et al. | 52/630 |
| 4,220,100 | 9/1980 | Palomo et al. | 108/51.1 |
| 4,411,121 | 10/1983 | Blacklin et al. | 52/792 |
| 4,420,922 | 12/1983 | Wilson | 52/802 |
| 4,426,824 | 1/1984 | Swensen | 52/794 |
| 4,442,645 | 4/1984 | Hiller et al. | 52/221 |
| 4,505,449 | 3/1985 | Twiner et al. | 52/126.6 |
| 4,574,555 | 3/1986 | Cline | 52/785 |
| 4,596,095 | 6/1986 | Chalfant | 52/126.6 |

FOREIGN PATENT DOCUMENTS

| | | | |
|---|---|---|---|
| 549809 | 12/1957 | Canada | 52/802 |
| 2328179 | 12/1974 | Fed. Rep. of Germany . | |
| 462428 | 3/1951 | Italy | 52/802 |
| 1173665 | 12/1969 | United Kingdom . | |

*Primary Examiner*—Michael Safavi
*Attorney, Agent, or Firm*—Nutter, McClennen & Fish

[57] ABSTRACT

A composite floor panel suitable for use in access or elevated floors comprises a surface plate and a base plate which may be manufactured from plastic and joined together by an adhesive. The top surface of the panel may be adapted to receive a preselected finishing material including carpeting, vinyl or any of a number of other commercially available wear surfaces. The composite panel is lightweight, does not require a conventional edge trim and may be adapted for use with conventional access floor support systems.

12 Claims, 1 Drawing Sheet

COMPOSITE ACCESS FLOOR PANEL

This application is a continuation of application Ser. No. 887,740, filed July 18, 1986, now abandoned.

BACKGROUND OF THE INVENTION

1. Field of the Invention

This invention relates to floor panels for "access" or elevated floors in which individual panels may be removed by the user to gain access to the area located beneath the surface of the floor. Access floors are used in a variety of applications, particularly in rooms which house computer equipment. Such rooms require a stable floor surface which can both support the sensitive equipment as well as provide easy access for the cabling associated with peripheral devices, user terminals and other equipment. The space beneath the access floor may also serve as distribution plenum in an air conditioning system.

2. Discussion of the Prior Art

Access floor panels known in the prior art are commonly constructed of metal, usually steel, which is often required to provide the necessary strength. Metal floor panels have several disadvantages which may render them unusable or undesirable in a variety of applications.

First, a metal floor panel is inherently heavy and may be quite difficult to handle depending on the size. This can be a serious problem during the installation of the access floor and where frequent, rapid removal of the panels is required. In addition, the weight of the panels increases the cost of the finished product due to higher shipping costs.

Second, a metal floor panel may not meet the user's specifications. For example, a user may desire that the surface of the access floor match or complement the floor coverings of adjacent areas. Metal panels may be painted a desired color, but a painted surface is subject to flaking and deterioration due to age, humidity and other factors. Paint particles can cause serious adverse effects on both air conditioning systems and sensitive electronic equipment.

A third disadvantage of metal panels is their tendency to promote acoustic reverberation due to the highly nonattenuating characteristic of the metal itself. Such reverberation can be propagated through the air conditioning system if the area beneath the floor is used as a distribution plenum.

Another disadvantage of metal panels is the difficulty in providing suitable openings or holes for the user's particular application. The user may desire one or more holes of different sizes and locations to accommodate cables and the like. It is often not practical to manufacture a metal panel with the proper openings. Instead, the panel must be bored and fitted with gaskets to protect the cables from the sharp edges of the bore.

Conventional metal panels typically require the addition of a separate edge trim to the perimeter of the panel. The edge trim is used to cover the gaps between adjacent panels and is highly susceptible to cracking or damage, especially when the panel is removed frequently.

Metal panels present an additional problem which is related to the process of cutting and fitting. In general, metal panels require special cutting tools and tend to create shavings or particles which can adversely affect sensitive equipment and air conditioning systems.

Finally, metal panels present a safety problem in that they tend to have sharp edges and corners. Typically, the user is instructed to use special tools to remove the panels in order to avoid injury. In practice, many users do not adhere to such instructions and risk serious injury by handling the metal panels.

SUMMARY OF THE INVENTION

The present invention provides a plastic composite floor panel which is suitable for access floors and other applications. The panel is lightweight and easy to handle. The top surface of the panel may be adapted to receive a user-selected finishing material such as carpet, vinyl or any of a number of other commercially available wear surface materials. The panel provides an improved acoustic damping characteristic, which tends to decrease reverberation in the area beneath the surface of the floor. The panel may include one or more holes whose size and location may be selected by the user in conformity with a particular application. The panel does not require a conventional edge trim member. No special tools are required to cut the panel and the panel exhibits improved safety in handling.

The panel comprises a surface plate and a base plate which are joined together. The top of the surface plate serves as the floor surface and may be adapted to accept a thin metal skin. In addition, a preselected finishing material, such as carpet, vinyl or other material, may be applied over the metal skin or, alternatively, directly on the surface plate. The bottom of the surface plate comprises a plurality of downwardly-extending integral ribs.

The top of the base plate comprises a plurality of grooves, which are arranged and adapted to receive the ribs of the surface plate such that the two plates may be joined together and bonded with an adhesive to form the composite floor panel. The bottom of the base plate may be adapted to receive a thin metal skin, similar to that which may be applied to the top of the surface plate.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DETAILED DESCRIPTION OF AN ILLUSTRATIVE EMBODIMENT

Figure 1:
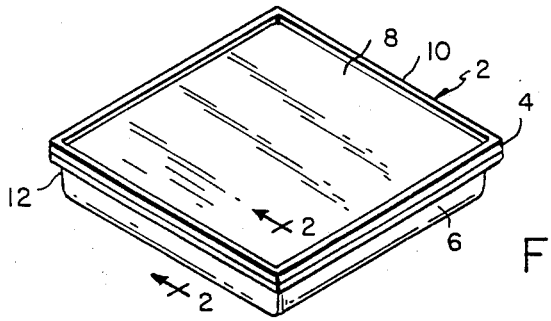
FIG. 1 is an isometric view of the preferred embodiment of a composite floor panel comprising a surface plate and a base plate constructed in accordance with the present invention.

FIG. 1 is an isometric view of the preferred embodiment of a composite floor panel 2 constructed in accordance with the present invention. A surface plate 4 is mounted upon a base plate 6. The surface plate 4 comprises a top surface 8 which may be substantially flat or, as shown in FIG. 1, may comprise a recessed area surrounded by a lip 10. The base plate 6 comprises a lateral lip 12 which extends around the perimeter of the floor panel 2.

Figure 2:
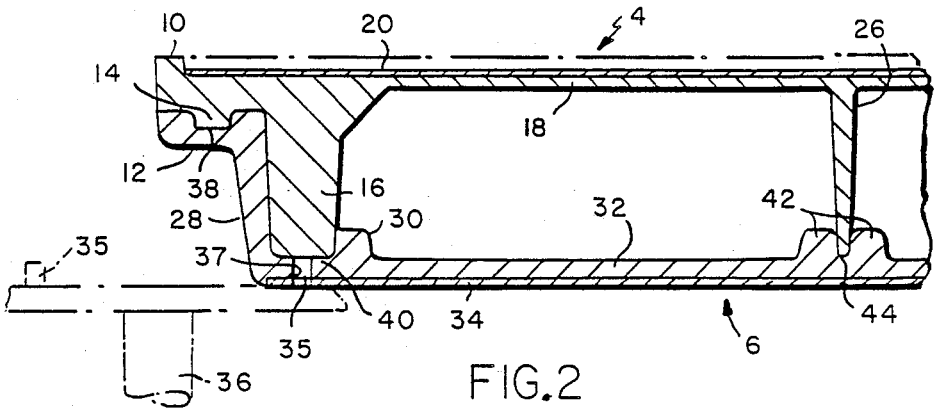
FIG. 2 is a partial cross-sectional view taken along line 2—2 of FIG. 1.
Figure 3:
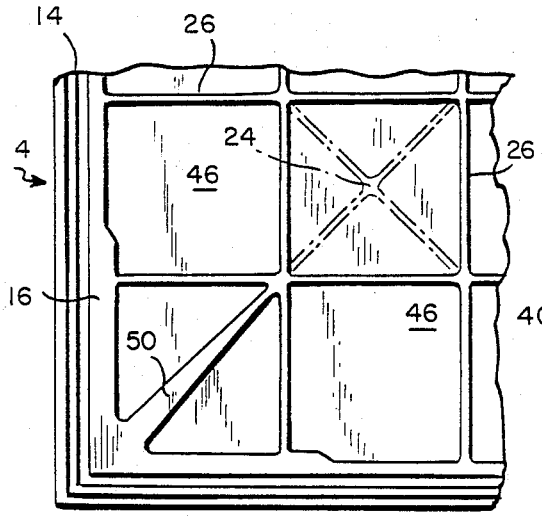
FIG. 3 is a partial bottom plan view of the surface plate shown in FIG. 1.

As may be seen more clearly in FIG. 2, which is a section taken along line 2—2 of FIG. 1, and FIG. 3, which is a bottom plan view of the surface plate 4, a webbing 18 extends laterally in a horizontal plane to connect an integral edge member 16 with a plurality of downwardly-extending integral ribs 26. The edge member 16 extends laterally in the shape of a rectangle around the bottom of the surface plate 4. The ribs 26 are arranged in a grid pattern and their ends are integrally connected to the edge member 16.

The grid pattern of the ribs defines a plurality of open areas or pockets 46. As shown in phantom in FIG. 3, a cross brace 24 may be disposed within one or more of the pockets 46. The ends of the cross brace 24 may be integrally connected with the adjacent ribs 26. Similarly, a diagonal brace 50 is disposed within the pocket which is located at the corner of the surface plate 4. The ends of the diagonal brace 50 are integrally connected with the edge member 16 and the adjacent ribs 26.

The lip 10 provides a preselected vertical clearance thereby defining a recessed area across the top surface 8. A skin member 20 is disposed within the recessed area. A finishing material, shown in phantom, may be applied to the skin member 20 so as to form a substantially flush surface with the lip 10. Alternatively, the finishing material may be applied directly to the webbing 18 in the absence of the skin member 20. An integral ridge 14 extends downwardly from the lip 10 and laterally around the perimeter of the surface plate 4.

Figure 4:
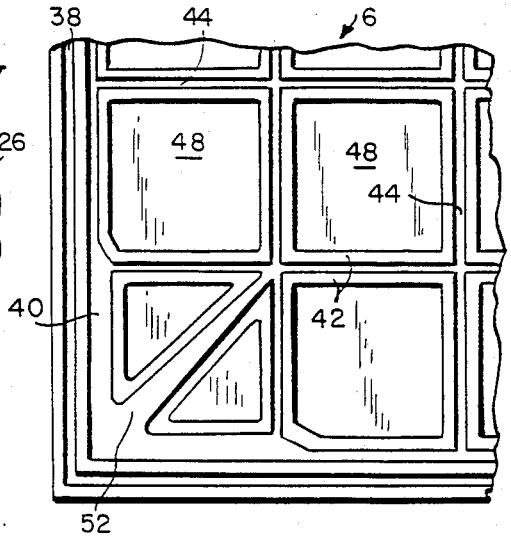
FIG. 4 is a partial top plan view of the base plate shown in FIG. 1.

Referring now to FIGS. 2 and 3, as well as to FIG. 4, which is a top plan view of the base plate 6, a webbing 32 extends laterally in a horizontal plane to connect an integral sidewall 28, an integral ridge 30, and a plurality of integral pairs of ridges 42. The sidewall 28 and the ridge 30 define a channel or groove 40 which is adapted to receive the edge member 16. Similarly, the pairs of ridges 42 define a plurality of grooves 44, arranged in a grid pattern, which are adapted to receive the ribs 26.

The grid pattern of the pairs of ridges 42 defines a plurality of pockets 48 which correspond to the pockets 46 of the surface plate. Thus, when the surface plate 4 and the base plate 6 are mated together, the pocket 48 may receive a cross brace 24 which is disposed within a pocket 46. Similarly, a groove 52, disposed within the corner of the base plate 6, is adapted to receive the diagonal brace 50 and a groove 38, disposed within the lateral lip 12, is adapted to receive the ridge 14. A skin member 34, similar to the skin member 20, is disposed within the webbing 32 so as to form a substantially flush bottom surface.

In general, the floor panel 2 may be adapted for use with any of a number of conventional access floor support systems. For example, a notch 37 may be disposed within each of the corners of the bottom of the floor panel 2. The notch 37 may be adapted to receive a peg 35 of a conventional pedestal support 36 known in the prior art. Thus, a plurality of pedestal supports 36 or other supports and floor panels 2 may be arranged to form an elevated or access floor.

The surface plate 4 and the base plate 6 may comprise, for example, a plastic material which is sold under the tradename Valox. Taken in sheet form, the plastic material may be heated and pressed into a mold using conventional compression molding techniques known in the prior art. The surface plate 4 and the base plate 6 may be formed as separate pieces which are subsequently joined together with an adhesive. The adhesive may comprise, for example, any of a number of commercially available adhesives of the spray-on film type.

The skin members 20 and 34 may comprise, for example, thin sheets of steel or aluminum depending on the strength requirements of the particular application. Similarly, the arrangement or spacing of the ribs 26, as well as the inclusion of the cross braces 24, may vary in view of the strength required. In general, the positions of the ribs 26 and the grooves 44 may be interchanged whereby the bottom surface of the surface plate 4 may comprise a plurality of grooves and the top surface of the base plate 6 may comprise a plurality of ribs. A similar interchange may occur with respect to the edge member 16 and the groove 40, as well as with the ridge 14 and the groove 38.

As described above, the top surface 8 of the surface plate 4 may be substantially flat or may comprise a recessed area surrounded by a lip (lip 10). The vertical clearance provided by the lip permits the application of a finishing material of the user's choice including carpeting, vinyl and other conventional wear surfaces. The finishing material may be directly molded into the surface plate 4 at the time of manufacture. Once applied, the finishing material forms a substantially flush surface with the lip 10. Thus, the lip 10 serves as an integral trim member and eliminates the need for a conventional trim edge. Typically, the lip 10 may provide a clearance of approximately 1/16″ to ⅛″ to accommodate a wide variety of finishing materials.

The surface plate 4 and base plate 6 may be manufactured with one or more preselected holes or openings which are disposed vertically through the composite floor panel 2. Such holes may include a grommet or collar for the protection of wiring which may pass through the opening. In general, the size and location of the holes may be selected by the user in accordance with a particular application.

The foregoing description has been limited to a specific embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed as new and desired to be secured by Letters Patent of the United States is:

1. A composite floor panel, said floor panel comprising:

A. surface plate means having a top surface and a bottom surface, said top surface of said surface plate means for forming a portion of a raised floor, said bottom surface of said surface plate means comprising a plurality of downwardly extending integral ribs,

1. said top surface of said surface plate means including a lip, said lip extending laterally around said top surface of said surface plate means thereby defining a first recessed area, a first skin member being disposed in said first recessed area; and B. base plate means having a top surface and bottom surface, said top surface of said base plate means comprising a plurality of grooves, said grooves being adapted to receive said ribs, whereby said surface plate means is joined to said base plate means to form said floor panel.

2. The composite floor panel as in claim 1 wherein a finishing material is disposed in said first recessed area.

3. The composite floor panel as in claim 1 wherein said bottom surface of said base plate means further comprises a second recessed area.

4. The composite floor panel as in claim 3 wherein a second skin member is disposed in said second recessed area.

5. The composite floor panel as in claim 1 wherein said ribs are arranged in a grid pattern, said grid pattern defining a plurality of substantially rectangular areas.

6. The composite floor panel as in claim 5 wherein a cross brace is disposed in one or more of said substantially rectangular areas.

7. A composite floor panel, said floor panel comprising:

A. surface plate means having a top surface and a bottom surface, said top surface of said surface plate means for forming a portion of a raised floor, said bottom surface of said surface plate means comprising a plurality of grooves, 1. said top surface of said surface plate means including a lip, said lip extending laterally around said top surface of said surface plate means thereby defining a first recessed area, a first skin member being disposed in said first recessed area; and B. base plate means having a top surface and bottom surface, said top surface of said base plate means comprising a plurality of upwardly extending integral ribs, said ribs being adapted to join with said grooves, whereby said surface plate means is joined to said base plate means to form said floor panel.

8. The composite floor panel as in claim 7 wherein a finishing material is disposed in said first recessed area.

9. The composite floor panel as in claim 7 wherein said bottom surface of said base plate means further comprises a second recessed area.

10. The composite floor panel as in claim 9 wherein a second skin member is disposed in said second recessed area.

11. The composite floor panel as in claim 7 wherein said ribs are arranged in a grid pattern, said grid pattern defining a plurality of substantially rectangular areas.

12. The composite floor panel as in claim 11 wherein a cross brace is disposed in one or more of said substantially rectangular areas.

* * * * *